US006758012B2

(12) United States Patent
Shimizu

(10) Patent No.: US 6,758,012 B2
(45) Date of Patent: Jul. 6, 2004

(54) ACTUATOR FOR OPERATING VEHICLE DOOR

(75) Inventor: Yoshihiro Shimizu, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 70 days.

(21) Appl. No.: 09/908,796

(22) Filed: Jul. 20, 2001

(65) Prior Publication Data

US 2002/0046496 A1 Apr. 25, 2002

(30) Foreign Application Priority Data

Jul. 26, 2000 (JP) ..... 2000-225707

(51) Int. Cl.[7] ..... E05F 15/08
(52) U.S. Cl. ..... 49/349
(58) Field of Search ..... 49/348, 349, 279, 49/280; 74/411, 421, 425, 325; 192/41 S, 81 C

(56) References Cited

U.S. PATENT DOCUMENTS 5,207,393 A * 5/1993 Marscholl ..... 49/349
6,003,193 A * 12/1999 Rivin et al. ..... 15/250.3
6,094,868 A * 8/2000 Otaka et al. ..... 49/349

FOREIGN PATENT DOCUMENTS

DE 2441010 * 9/1975
JP 2000-27508 A 1/2000

* cited by examiner

*Primary Examiner*—Jerry Redman
(74) *Attorney, Agent, or Firm*—Burns, Doane, Swecker & Mathis, L.L.P.

(57) ABSTRACT

An actuator for operating a vehicle door includes a spring that is adapted to frictionally connect a wheel gear and an output gear upon actuation of an electric motor. The wheel gear and the output gear are operatively connected by the frictional contact of the spring relative to the wheel gear and the output gear upon actuation of the electric motor. The spring separates the wheel gear and the output gear to return the output gear to an initial position when operation of the electric motor is stopped.

21 Claims, 5 Drawing Sheets

ACTUATOR FOR OPERATING VEHICLE DOOR

This application is based on and claims priority under 35 U.S.C. §119 with respect to Japanese Application No. 2000-225707 filed on Jul. 26, 2000, the entire content of which is incorporated herein by reference.

FIELD OF THE INVENTION

The present invention generally relates to an actuator for operating a door. More particularly, the present invention pertains to an actuator for effecting the opening, closing, locking and/or unlocking operation of a vehicle door.

BACKGROUND OF THE INVENTION

Japanese Patent Laid-Open Publication No. 2000-27508 discloses a known actuator for operating a vehicle door. The known actuator for operating a door includes an electric motor, a deceleration gear mechanism, and an output member operatively connected to the electric motor via the deceleration gear mechanism. The output member is operated from an initial position to a predetermined operational position through actuation of the electric motor via the deceleration gear mechanism.

In this known vehicle door operating actuator, the deceleration gear mechanism includes a return spring. The deceleration gear operates the output member from an initial position to a predetermined operational position while deflecting the return spring upon actuation of the electric motor. After stopping operation of the electric motor, the output member returns from the operational position to the initial position by reverse operation of the deceleration gear through the biasing force of the return spring.

With the known actuator mentioned above, including the deceleration gear mechanism having the return spring for enabling returning operation of the output member, the return spring is deflected by the deceleration gear mechanism while operating the output member from the initial position to the operational position. Accordingly, the driving torque of the electric motor transmitted to the output member is partly lost by the deflection of the return spring. Further, because the return spring is gradually deflected in accordance with the operation of the output member, the driving torque loss of the electric motor is gradually increased and so it becomes difficult to operate the output member at a constant driving torque. Hence, considering the loss of the driving torque, a relatively large size electric motor is necessary for ensuring sufficient driving torque for the output member. As a result, the size of the actuator is increased.

A needs thus exists for an actuator for operating a vehicle door in which the size of the electric motor, and the size of the overall actuator, is minimized.

SUMMARY OF THE INVENTION

According to one aspect of the invention, an actuator for operating a vehicle door includes an electric motor, a deceleration gear mechanism, an output member operatively connected to the electric motor via the deceleration gear mechanism and operable from an initial position to a predetermined operational position, and a spring disposed between the deceleration gear mechanism and the output member to effect a frictional connection with the output member and the deceleration gear mechanism for connecting and disconnecting the deceleration gear mechanism and the output member. The output member and the deceleration gear mechanism are connected to one another by the frictional connection of the spring with the deceleration gear mechanism and the output member during actuation of the electric motor to move the output member to the operational position, and the output member is returned from the operational position to the initial position by release of the frictional connection to separate the deceleration gear mechanism and the output member when operation of the electric motor is stopped.

According to another aspect of the invention, an actuator for operating a vehicle door includes a housing, an electric motor accommodated in the housing and having an output shaft, a worm gear engaged with the output shaft of the electric motor, a wheel gear rotatably supported in the housing and engaged with the worm gear, and a first output member rotatably supported in the housing coaxially with the wheel gear. The first output member and the wheel gear each have a shaft portion. A spring case is supported by the housing and a spring is accommodated in the spring case. The spring is disposed around the shaft portion of the wheel gear and the shaft portion of the first output member for frictionally engaging an outer peripheral surface of the shaft portion of the wheel gear and an outer peripheral surface of the shaft portion of the first output member. One end of the spring is maintained by the wheel gear and the other end of the spring is maintained by the spring case.

In accordance with a further aspect of the invention, an actuator for operating a vehicle door includes a housing, an electric motor mounted at the housing, a wheel gear rotatably mounted at the housing and operatively connected to the motor to rotate in response to operation of the motor, an output gear rotatably mounted at the housing, a rotatable output member operatively connected to the output gear to rotate in response to rotation of the output gear to move from an initial position to an operational position, and a spring disposed adjacent the wheel gear and the output gear to frictionally engage the wheel gear with the output gear upon operation of the motor to operationally connect the wheel gear and the output gear so that rotational movement of the wheel gear is transferred to the output gear and then to the output member to move the output member from the initial position to the operational position.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
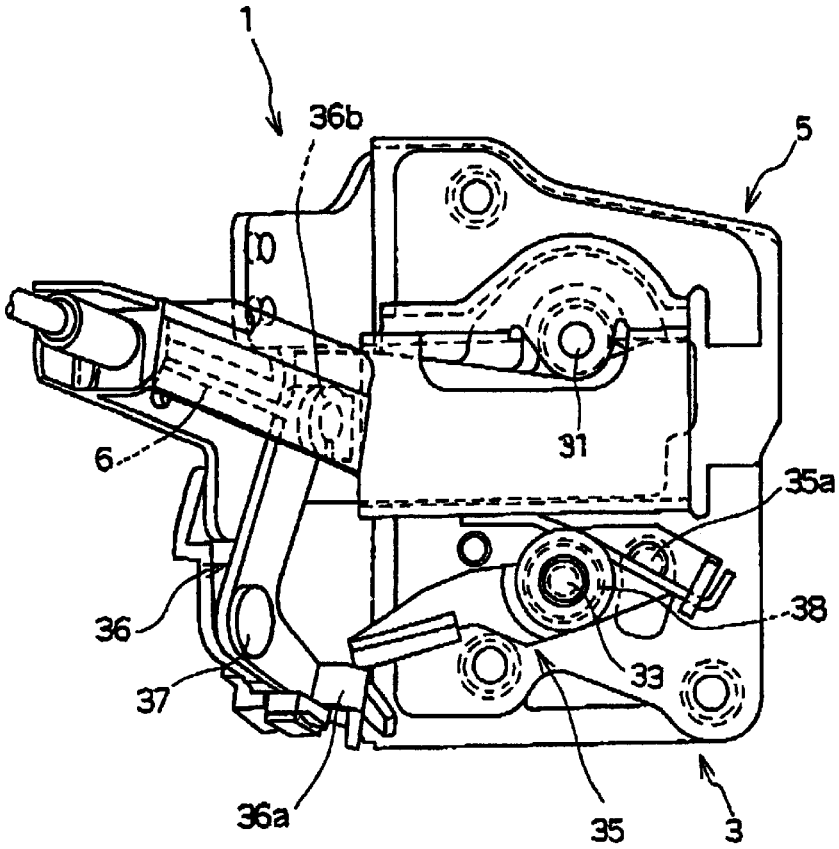
FIG. 1 is a front view of a door lock device operatively connected to an actuator for operating a door according to the present invention.
Figure 2:
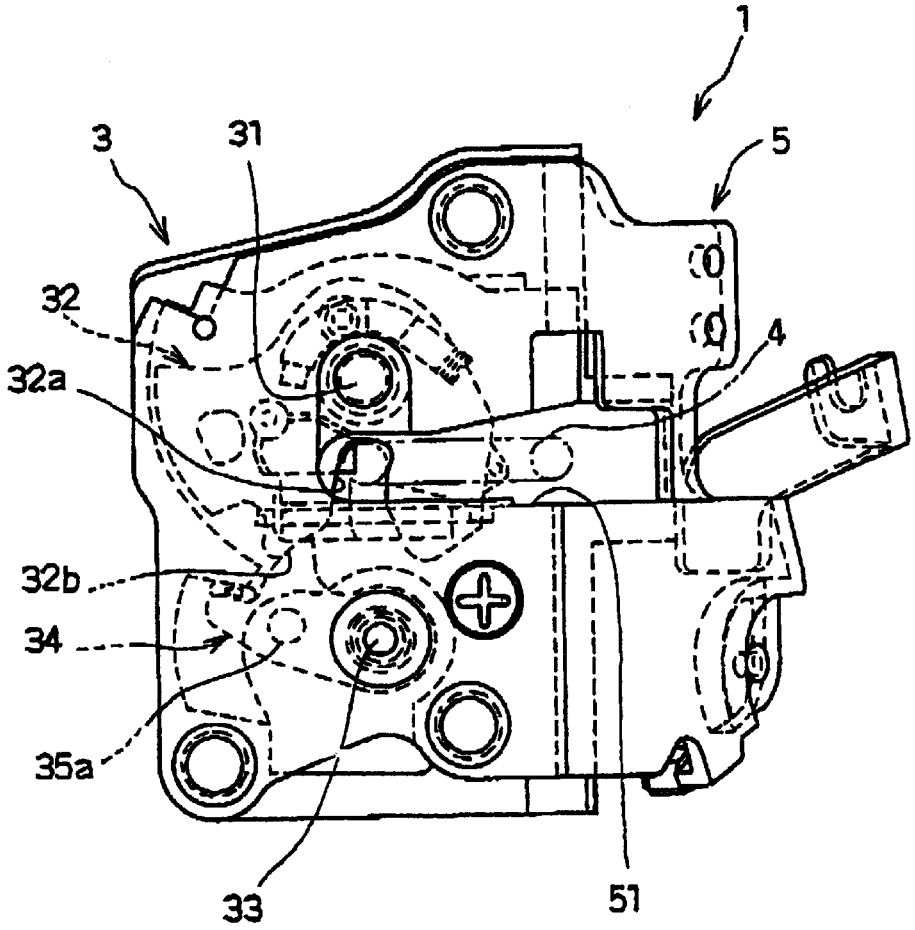
FIG. 2 is a rear view of the door lock device shown in FIG. 1.

FIGS. 1 and 2 show a door lock device 1 for maintaining a vehicle door in a closed position relative to a vehicle body while FIGS. 3–7 show a latch release actuator 2 for operating the door lock device 1. The door lock device can be used in connection with various types of vehicle doors, including swing type doors, sliding type side doors, rear doors, and trunk lids.

Referring to FIGS. 1 and 2, the door lock device includes a latch mechanism 3 provided on the vehicle door and a striker secured to the vehicle body. The latch mechanism 3 includes a latch 32 and a pawl 34. The latch 32 is accommodated in a body 5 which can be made of resin and is rotatably supported by a latch shaft 31 for movement between a latched position and an unlatched position. The pawl 34 is rotatably supported by a pawl shaft 33 for movement between an engaging position and a releasing position. A U-shaped notch 51 is formed in the body 5 for receiving the striker 4. A U-shaped engaging groove 32*a* is formed at the outer periphery of the latch 32 and extends in the radial direction. The engaging groove 32*a* is adapted to engage the striker 4 after the striker 4 moves into the notch 51. An engaging claw 32*b* is formed on the outer surface of the latch 32 for engaging and disengaging the pawl 34.

The pawl shaft 33 which supports the pawl 34 penetrates and extends into the body 5. The pawl shaft 33 also rotatably supports a first open lever 35 for movement between an initial position and an operational position. The first open lever 35 is connected to the pawl 34 by a pin 35*a* located at one end of the lever 35 so that the first open lever 35 and the pawl 34 are unitarily joined and rotate together with one another. A second open lever 36 is rotatably supported on the body 5 by a pin 37 for movement between an initial position and an operational position. One end of the second open lever 36 is provided with a contacting portion 36*a* that contacts the other end of the first open lever 35. A stopper 36*b* is disposed at the other end of the second open lever 36.

Figure 3:
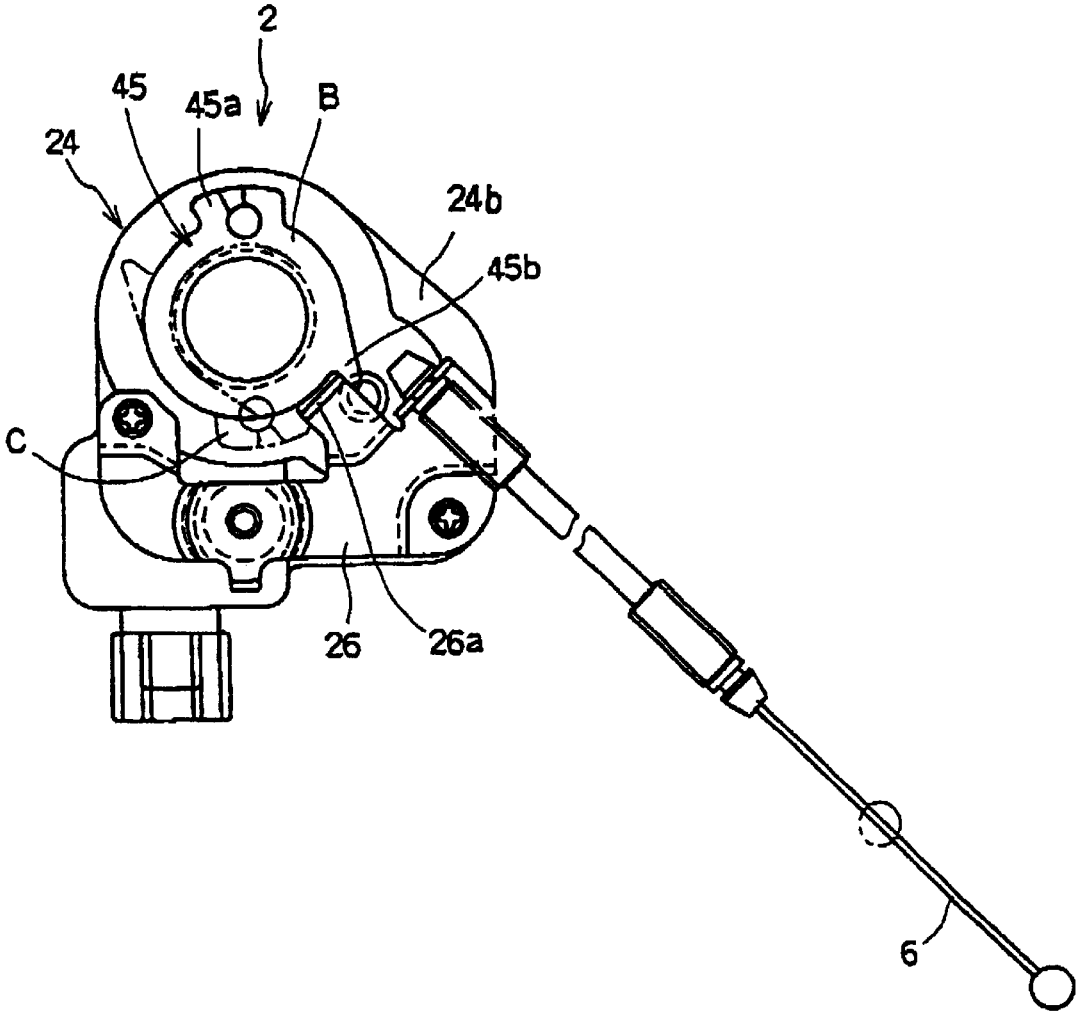
FIG. 3 is a side view of the actuator according to the present invention that is operatively connected to the door lock device shown in FIGS. 1 and 2 for operating the door.

The stopper 36*b* stops or engages one end of a cable 6 that is connected to an output pulley 45 of the latch release actuator 2 as shown in FIG. 3. The second open lever 36 is connected to the output pulley 45 via the cable 6 so that the second open lever 36 is operated or rotated by the operation of the output pulley 45. A torsion spring 38 is wound around the pawl shaft 33 and has one end engaged with the first open lever 35 and the other end engaged with the body 5. The first open lever 35 and the second open lever 36 are always rotatably biased in the direction of the initial position by the biasing force of the torsion spring 38.

FIG. 2 shows a latched condition in which the latch 32 is at a latched position and the pawl 34 restricts the rotation of the latch 32 to the unlatched position by the engagement of the engaging claw 32*b* with the latch 32. In this condition, the striker 4 is engaged in the U-shaped engaging groove 32*a* to maintain the vehicle door in the closed condition relative to the vehicle body. FIG. 1 shows a condition in which the first open lever 35 and the second open lever 36 are at the initial position. In this condition, the latch release actuator 2 is not operated.

When the second open lever 36 is operated to rotate in the counterclockwise direction of FIG. 1 through a predetermined rotational angle from the initial position shown in FIG. 1 to the operational position, the contacting portion 36*a* of the second open lever 36 contacts the other end of the first open lever 35. The first open lever 35 is thus rotated in the clockwise direction of FIG. 1 through a predetermined rotational angle from the initial position to the operational position against the biasing force of the torsion spring. The first open lever 35 thus rotates the pawl 34 via the pin 35*a* in the counterclockwise direction of FIG. 2 through a predetermined rotational angle from the engagement position to the releasing position, thus releasing the engagement between the pawl 34 and the engaging claw 32*b* of the latch 32. As a result, the rotational restriction of the latch 32 to the unlatched position is released and the door can be opened relative to the vehicle body.

Referring to FIGS. 3–6, the latch release actuator 2 includes an electric motor 21, a deceleration gear mechanism 22, and an output device 23. The electric motor 21 and the deceleration gear mechanism 22 are accommodated in a housing 24 which can be made of resin. The housing 24 is defined by a case 24*a* and a cover 24*b* that form a box-shaped housing 24 having an internal space A for accommodating the electric motor 21 and the deceleration gear mechanism 22.

The deceleration gear mechanism 22 includes a worm gear 41 and a wheel gear 42. The worm gear 41 is secured in a unitary manner to an output shaft 21*a* of the electric motor 21 so that rotation of the output shaft 21*a* results in rotation of the worm gear 41. The wheel gear 42 includes a boss portion 42*a* that is rotatably supported by a pin 25 provided in the housing 24. The outer peripheral surface of the wheel gear 42 has a teeth portion 42*b* that engages the worm gear 41. The engagement between the worm gear 41 and the wheel gear 42 is predetermined with a relatively large pressure angle. Thus, the worm gear 41 can rotate the wheel gear 42 and vice versa.

Figure 6:
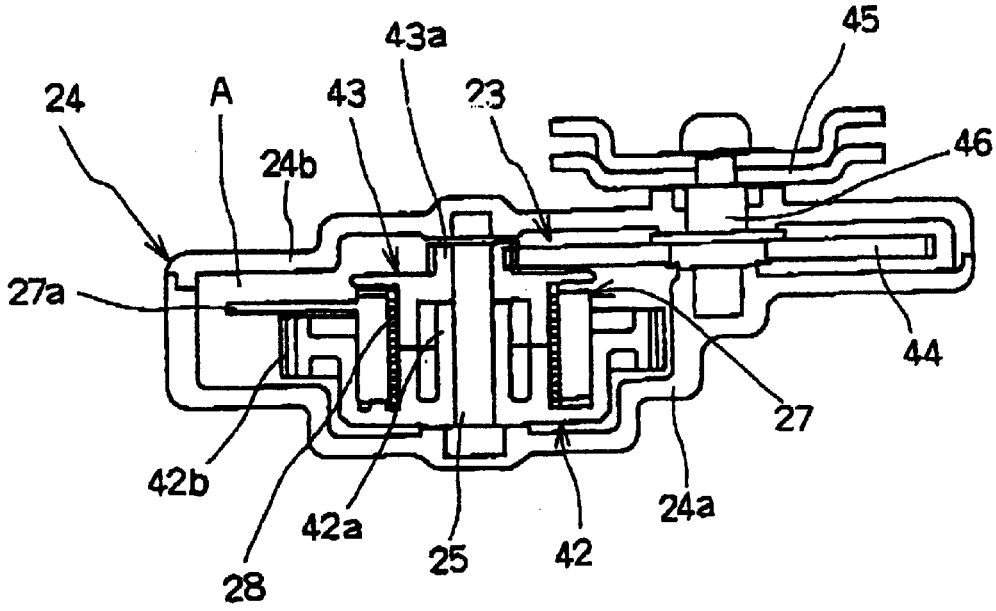
FIG. 6 is a cross-sectional view taken along the section line VI—VI in FIG. 4.

The output device 23 includes a first output gear 43 constituting a first output member, a second output gear 44 constituting a second output member, and the output pulley 45 constituting a third output member. The first output gear 43 engages the second output gear 44. The first output gear 43 is accommodated in the housing 24 and includes a boss portion 43*a* that is rotatably supported by the pin 25 so that the first output gear 43 is rotatable relative to the wheel gear 42. An output pin 46 positioned approximately parallel to the pin 25 is rotatably supported by the housing 24. A first end of the output pin 46 extends in the housing 24, and the second output gear 44 which is accommodated in the housing 24 is secured to the first end of the output pin 46 so that the output pin 46 and the second output gear 44 rotate in a unitary manner. The second end of the output pin 46 extends outside of the housing 24 as shown in FIG. 6.

The output pulley 45 is provided outside of the housing 24 and is secured to the second end of the output pin 46 in a unitary rotatable manner for rotating movement between an initial position B (shown by the solid line position in FIG. 3) and an operational position C (shown by the double-dash chain line position in FIG. 3). A stopper 45*a* is formed on the output pulley 45 for stopping or engaging the other end of the cable 6 that is connected to the second open lever 36 of the door lock device 1.

The second open lever 36 is operated in accordance with the rotation of the output pulley 45 from the initial position B to the operational position C. The initial position B of the output pulley 45 is restricted by contact between a stopper wall 26*a* formed on a bracket 26 fixed to the housing 24 and a claw portion 45*b* formed on the output pulley 45. The operational position C is restricted by a contact between the stopper wall 26*a* and the stopper 45*a*.

Figure 7:
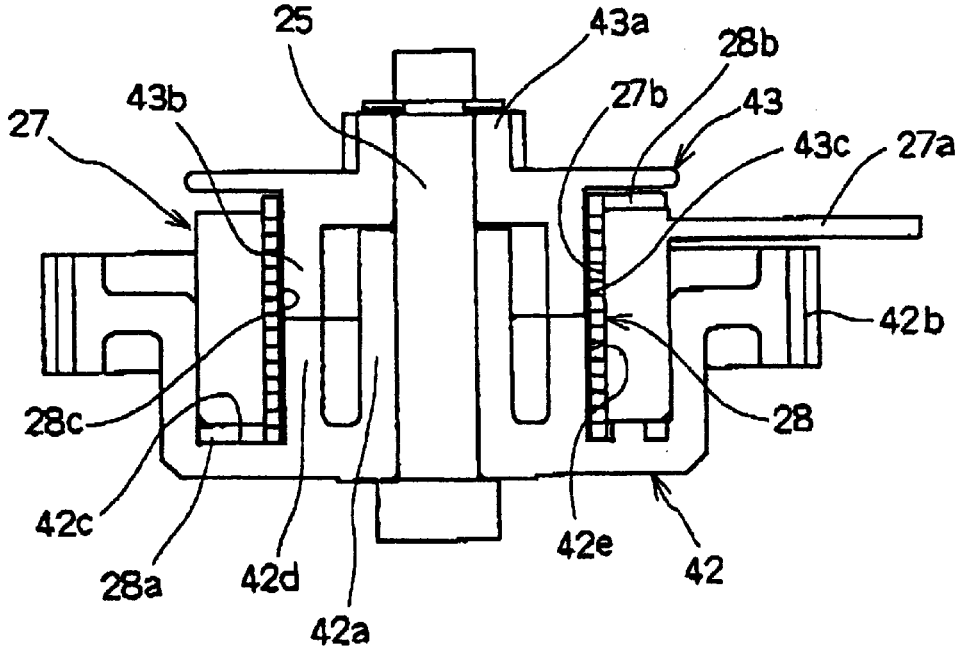
FIG. 7 is an enlarged cross-sectional view of a portion of the actuator shown in FIG. 6.

A spring case 27 is provided around the pin 25 and is non-rotatably supported in the housing 24 at a projection portion 27*a*. Referring to FIG. 7, the cylindrical spring case 27 has an inner peripheral surface 27*b* and is accommodated in a concave portion 42*c* formed in the wheel gear 42. The wheel gear 42 includes an annular shaft portion 42*d* and the first output gear 43 also includes an annular shaft portion 43*b*. The boss portion 42*a* of the wheel gear 42 is accommodated inside the shaft portion 43*b* of the first output gear 43. The shaft portion 42*d* of the wheel gear 42 and the shaft portion 43*b* of the first output gear 43 are positioned in opposing relation to one another in the axial direction of the pin 25 so that the end surfaces of the shaft portion 42*d* and the shaft portion face one another as shown in FIG. 7.

The shaft portion 42*d* and the shaft portion 43*b* that are positioned in opposing relation to one another include outer peripheral surfaces 42*e*, 43*c* respectively which are substantially aligned with one another in the axial direction of the pin 25 in the manner illustrated in FIG. 7. The shaft portion 42*d* and the shaft portion 43*b* are accommodated in the spring case 27. The outer peripheral surface 42*e* of the shaft portion 42*d* and the outer peripheral surface 43*c* of the shaft portion 43*b* are opposed to and positioned in facing relation to the inner peripheral surface 27*b* of the spring case 27 while maintaining a predetermined distance or spacing.

As shown in FIG. 7, a spring 28 is provided in the spring case 27. The spring 28 is wound around the outer peripheral surfaces 42*e*, 43*c* of the shaft portions 42*d*, 43*b* and along the inner peripheral surface 27*b* of the spring case 27 in the axial direction of the pin 25. One end 28*a* of the spring 28 is engaged with the wheel gear 42 while the other end 28*b* of the spring 28 is fixed to the spring case 27 with pressure in the axial direction of the pin 25. The inner peripheral surface 28*c* of the spring 28 is capable of frictionally contacting the outer peripheral surfaces 42*e*, 43*c* of the shaft portions 42*d*, 43*b*. The frictional contact between the inner peripheral surface 28*c* of the spring 28 and the outer peripheral surfaces 42*e*, 43*c* of the shaft portions 42*d*, 43*b* connects the wheel gear 42 and the first output gear 43. Thus, the wheel gear 42 and the first output gear 43 are rotated together in a unitary manner.

In this embodiment of the present invention, the concave or recessed portion 42*c* of the wheel gear 42 accommodates the spring case 27 which accommodates the shaft portions 42*d*, 43*b* and the spring 28. The shaft portion 42*d* of the wheel gear 42 and the shaft portion 43*b* of the first output gear 43 are provided in opposing relation to one another by accommodating the boss portion 42*a* of the wheel gear 42 in the inside of the shaft portion 43*b* of the first output gear 43. Accordingly, the latch release actuator 2 can be made smaller, thus permitting the latch release actuator 2 to be made thinner in the axial direction.

The operation of the latch release actuator 2 is as follows. When the worm gear 41 is rotated by the driving operation of the electric motor 21, the wheel gear 42 that is geared or engaged with the worm gear 41 is rotated in the clockwise direction of FIG. 4. Because the one end 28*a* of the spring 28 is maintained by or engaged with the wheel gear 42 while the other end 28*b* of the spring 2 is maintained by or engaged with the spring case 27, the rotation of the wheel gear 42 compresses the spring 28 to tighten the spring 28 relative to the wheel gear 42 and the first output gear 43. The inner peripheral surface 28*c* of the spring 28 is thus frictionally contacted or engaged with the outer peripheral surface 42*e* of the shaft portion 42*d* of the wheel gear 42 and the outer peripheral surface 43*c* of the shaft portion 43*b* of the first output gear 43. Accordingly, the spring 28 operationally connects the wheel gear 42 and the first output gear 43 so that the rotation of the wheel gear 42 is transmitted to the first output gear 43. The first output gear 43 is thus rotated in the clockwise direction of FIG. 4.

Figure 4:
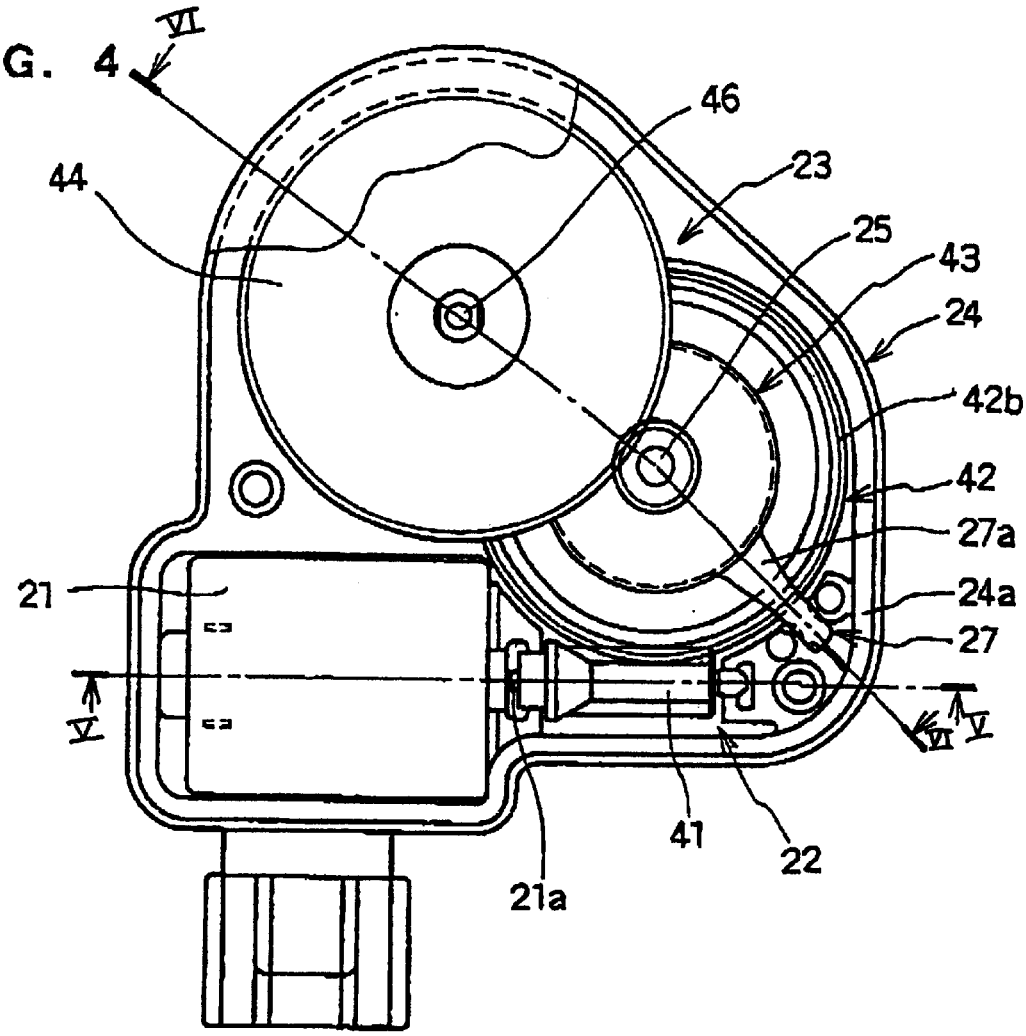
FIG. 4 is a slightly enlarged side view of the actuator shown in FIG. 3 with the cover of the housing removed.
Figure 5:
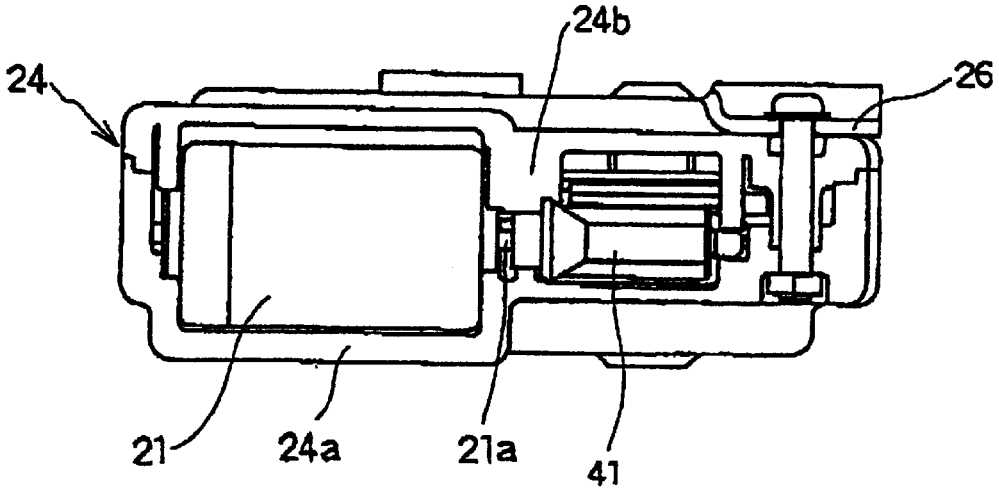
FIG. 5 is a cross-sectional view taken along the section line V—V in FIG. 4.

This rotation of the first output gear 43 causes the second output gear 44 which is geared or engaged with the first output gear 43 to rotate in the counterclockwise direction of FIG. 4. The output pulley 45 which rotates in a unitary manner with the second output gear 44 is thus rotated in the counterclockwise direction of FIG. 3 from the initial position B to the operational position C. The rotation of the output pulley 45 draws or pulls the cable 6 to the left in FIG. 3. As a result, the second open lever 36 of the door lock device 1 that is connected to the cable 6 is operated. Thus, the first open lever 35 and the second open lever 36 are rotated from the initial position to the operational position against the biasing force of the torsion spring 38.

When the electric motor 21 is stopped, the rotation of the worm gear 41 and the wheel gear 42 stops. Accordingly, the spring 28 releases the tightening or frictional grip between the wheel gear 42 and the first output gear 43 while rotating the wheel gear 42 in the counterclockwise direction of FIG. 4 (i.e., the reverse direction). This release of the tightening or frictional engagement of the spring 28 is conducted smoothly approximately simultaneously with the stop of the electric motor 21 due to the capability of reverse rotation from the wheel gear 42 to the worm gear 41. Accordingly, the fictional connection between the inner peripheral surface 28*c* of the spring 28 and the outer peripheral surfaces 42*e*, 43*c* of the shaft portions 42*d*, 43*b* of the wheel gear 42, and so the wheel gear 42 and the first output gear 43 are separated or no longer operationally connected to one another. As a result, the first output gear 43, the second output gear 44, and the output pulley 45 are able to freely rotate relative to the wheel gear 42. Thus, the first open lever 35 and the second open lever 36 smoothly return from the operational position to the initial position by the biasing force of the torsion spring 38 along with the first output gear 43, the second output gear 44 and the output pulley 45.

Although the latch release actuator of the present invention is described in the context of operating the open lever of the door lock device, the actuator can be applied in other contexts for operating a vehicle door such as a close actuator for operating a latch lever of the door lock device operating the vehicle door to a closed state, a lock actuator for operating a locking lever of a door lock device for locking and unlocking a vehicle door, and an unlock actuator.

In accordance with the described embodiment of the present invention, the deceleration gear mechanism and the output member are operationally connected and disconnected through the spring which is adapted to be frictionally connected to the deceleration gear mechanism and the output member. Accordingly, the actuator for operating the vehicle door in accordance with the present invention does not require a return spring as is the case with the deceleration gear mechanism used in other known actuators as described above. It is thus possible to transmit a relatively constant driving torque of the electric motor while reducing the loss of the driving torque, while at the same time reducing the size of the electric motor and the overall actuator. In addition, operational noise generated during driving operation and returning operation of the device is reduced.

Also, with the actuator described above, the frictional connection and the release of the frictional connection of the spring is conducted by the driving operation of the electric motor and the stopping of the such driving operation.

Accordingly, the number of parts is reduced as is the size and manufacturing cost associated with the actuator.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the apart and scope of the present invention as defined in the claims, be embraced thereby.

What is claimed is:

1. An actuator for operating a vehicle door comprising:

a housing;

an electric motor accommodated in the housing and having an output shaft;

a worm gear engaged with the output shaft of the electric motor;

a wheel gear rotatably supported in the housing and engaged with the worm gear, the wheel gear having a shaft portion;

a first output member rotatably supported in the housing coaxially with the wheel gear and having a shaft portion;

a spring case supported by the housing; and a spring accommodated in the spring case, the spring being disposed around the shaft portion of the wheel gear and the shaft portion of the first output member for frictionally engaging an outer peripheral surface of the shaft portion of the wheel gear and an outer peripheral surface of the shaft portion of the first output member, with the frictional engagement operationally connecting the wheel gear to the first output member so that rotation of the wheel gear is transmitted to the first output member by way of the spring, one end of the spring being maintained by the wheel gear and another end of the spring being maintained by the spring case.

2. The actuator for operating a vehicle door according to claim 1, including a second output member accommodated in the housing and engaging the first output member, and a third output member disposed outside the housing and rotatable in a unitary manner with the second output member, the third output member being adapted to be connected to a door lock mechanism for maintaining the vehicle door in a closed position relative to a vehicle body.

3. The actuator for operating a vehicle door according to claim 2, wherein the wheel gear and the first output member are supported on a common pin.

4. The actuator for operating a vehicle door according to claim 1, wherein the shaft portion of the first output member and the shaft portion of the wheel gear are oriented in axially opposing relation to one another.

5. The actuator for operating a vehicle door according to claim 1, wherein the spring case has an inner peripheral surface, the shaft portion of the first output member and the shaft portion of the wheel gear being accommodated in the spring case so that an outer peripheral surface of the shaft portion of the first output member faces the inner peripheral surface of the spring case and so that an outer peripheral surface of the shaft portion of the wheel gear faces the inner peripheral surface of the spring case.

6. The actuator for operating a vehicle door according to claim 1, wherein the spring is positioned in a space located between the spring case and the shaft portions of the first output member and the wheel gear.

7. An actuator for operating a vehicle door comprising:

a housing;

an electric motor mounted at the housing;

a wheel gear rotatably mounted at the housing and operatively connected to the motor to rotate in response to operation of the motor;

an output gear rotatably mounted at the housing;

a rotatable output member operatively connected to the output gear to rotate in response to rotation of the output gear to move from an initial position to an operational position;

a spring disposed adjacent the wheel gear and the output gear to frictionally engage the wheel gear and the output gear upon operation of the motor to operationally connect the wheel gear and the output gear so that rotational movement of the wheel gear is transferred to the output gear and then to the output member to move the output member from the initial position to the operational position.

8. The actuator for operating a vehicle door according to claim 7, including a worm gear secured to an output shaft of the electric motor, the wheel gear being operatively connected to the motor by way of the worm gear, a rotational force of the worm gear being transmitted to the wheel gear during operation of the motor, and a rotational force of the wheel gear being transmitted to the worm gear when the operation of the electric motor is stopped.

9. The actuator for operating a vehicle door according to claim 7, wherein the output gear and the wheel gear are supported on a common pin.

10. The actuator for operating a vehicle door according to claim 7, wherein the output gear includes a shaft portion and the wheel gear includes a shaft portion, the shaft portion of the output gear and the shaft portion of the wheel gear being oriented in axially opposing relation to one another, the spring encircling the shaft portion of the wheel gear and the shaft portion of the output gear, one end of the spring being connected to the wheel gear.

11. The actuator for operating a vehicle door according to claim 7, wherein the output gear includes a shaft portion and the wheel gear includes a shaft portion, the spring being accommodated in a spring case which has an inner peripheral surface, the shaft portion of the output gear and the shaft portion of the wheel gear being accommodated in the spring case so that an outer peripheral surface of the shaft portion of the output gear faces the inner peripheral surface of the spring case and so that an outer peripheral surface of the shaft portion of the wheel gear faces the inner peripheral surface of the spring case.

12. The actuator for operating a vehicle door according to claim 7, wherein the output member is an output pulley mounted on a shaft, the output pulley being connected to a cable.

13. The actuator for operating a vehicle door according to claim 7, wherein during non-operation of the motor, the frictional engagement of the spring with the wheel gear and the output gear is released so that the wheel gear and the output gear are rotatable relative to one another.

14. An actuator for operating a vehicle door comprising:

an electric motor;

a deceleration gear mechanism;

an output member operatively connected to the electric motor via the deceleration gear mechanism and operable from an initial position to a predetermined operational position;

a spring disposed between the deceleration gear mechanism and the output member to effect a frictional connection with the output member and the deceleration gear mechanism which connects the deceleration gear mechanism to the output member and disconnects the deceleration gear mechanism from the output member; and the output member and the deceleration gear mechanism being connected to one another by the frictional connection of the spring with the deceleration gear mechanism and the output member during actuation of the electric motor to move the output member to the operational position, and the output member being returned from the operational position to the initial position by release of the frictional connection to separate the deceleration gear mechanism and the output member when operation of the electric motor is stopped.

15. The actuator for operating a vehicle door according to claim 14, wherein the deceleration gear mechanism includes a worm gear secured to an output shaft of the electric motor and a wheel gear engaged with the worm gear and adapted to effect reverse operation, a rotational force of the worm gear being transmitted to the wheel gear during operation of the electric motor and a rotational force of the wheel gear being transmitted to the worm gear when the operation of the electric motor is stopped.

16. The actuator for operating a vehicle door according to claim 14 wherein the deceleration gear mechanism includes a wheel gear operatively connected with an output of the motor, and the output member including a first output gear and a second output gear, the first output gear and the wheel gear being supported on a common pin.

17. The actuator for operating a vehicle door according to claim 16, wherein the first output gear includes a shaft portion and the wheel gear includes a shaft portion, the shaft portion of the first output gear and the shaft portion of the wheel gear being oriented in axially opposing relation to one another.

18. The actuator for operating a vehicle door according to claim 17, wherein the spring is provided in a spring case which has an inner peripheral surface, the shaft portion of the first output gear and the shaft portion of the wheel gear being accommodated in the spring case so that an outer peripheral surface of the shaft portion of the first output gear faces the inner peripheral surface of the spring case and so that an outer peripheral surface of the shaft portion of the wheel gear faces the inner peripheral surface of the spring case.

19. The actuator for operating a vehicle door according to claim 17, wherein the spring is provided in a spring case and is positioned in a space located between the spring case and the shaft portions of the first output gear and the wheel gear.

20. The actuator for operating a vehicle door according to claim 16, wherein the output member includes an output pulley mounted on a shaft, said second output gear being supported on the shaft.

21. The actuator for operating a vehicle door according to claim 20, wherein the output pulley is connected to a cable.

* * * * *